US007258286B1

(12) United States Patent
Wang et al.

(10) Patent No.: US 7,258,286 B1
(45) Date of Patent: Aug. 21, 2007

(54) WATER SHUTOFF AND DISCHARGE CONTROL DEVICE FOR SPRINKLERS

(75) Inventors: King Yuan Wang, Changhua Hsien (TW); Shun Nan Lo, Changhua Hsien (TW); Chi Han Cheng, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 0 days.

(21) Appl. No.: 11/477,619

(22) Filed: Jun. 30, 2006

(30) Foreign Application Priority Data

Mar. 24, 2006 (TW) ..... 95110266 A

(51) Int. Cl.
*A62C 37/20* (2006.01)

(52) U.S. Cl. ..... 239/562; 239/240; 239/242; 239/443; 239/551; 239/566; 239/583; 239/586; 239/DIG. 1

(58) Field of Classification Search ..... 239/237, 239/240, 242, 436, 443, 444, 551, 562–564, 239/566, 583, 586, DIG. 1
See application file for complete search history.

(56) References Cited

U.S. PATENT DOCUMENTS 3,212,719 A * 10/1965 Di Corpo ..... 239/562
5,042,719 A * 8/1991 Magris et al. ..... 239/242
5,052,622 A * 10/1991 Lindermeir et al. ..... 239/562
5,305,956 A * 4/1994 Wang ..... 239/242
5,350,115 A * 9/1994 Burnworth et al. ..... 239/242
5,511,727 A * 4/1996 Heren et al. ..... 239/562
5,562,247 A * 10/1996 Roman ..... 239/240
5,628,458 A * 5/1997 Kuo ..... 239/242
5,657,928 A * 8/1997 Jian ..... 239/566
5,735,462 A * 4/1998 Roman ..... 239/242
6,736,340 B1 * 5/2004 Wang ..... 239/551

* cited by examiner

*Primary Examiner*—Steven J. Ganey
(74) *Attorney, Agent, or Firm*—Troxell Law Office, PLLC

(57) ABSTRACT

A water shutoff and discharge control device for sprinklers comprises a water intake assembly mounted to a support seat and swung back-and-forth by a sprinkling control assembly wherein the water intake assembly has a tube with multiple bores drilled thereon for the mounting of a sealing strip equipped with multiple spray nozzles and water-sealing areas. Both end sections of the tube are disposed multiple control channels each connecting to the interior of the tube for the extension of a control shaft with a plug mounted thereto. Each plug having an inlet aperture and an abutment surface is corresponded to a water-sealing area of the sealing strip to reveal a movement space there-between, permitting the plug flushed by the water flow to climb upwards and, depending on the movement of the control shaft, to switch in position relative to the spray nozzle for easy control of water shutoff or discharge thereby.

14 Claims, 20 Drawing Sheets

WATER SHUTOFF AND DISCHARGE CONTROL DEVICE FOR SPRINKLERS

BACKGROUND OF THE INVENTION

The present invention relates to a water shutoff and discharge control device for sprinklers, utilizing multiple plugs each accommodated to a control shaft and flushed upwards by water pressure to contact a water-sealing area of a sealing strip so as to reduce the contact area and the frictional coefficient thereof for more efforts-saving operation of the control shaft thereby. Besides, in case of high water pressure, the plug will be further reinforced by the strong current of the water flow to abut watertight against the water-sealing area of the sealing strip, avoiding water leaking through spray nozzles or bores to achieve better waterproof effect thereby.

A conventional sprinkler 10 as disclosed in a Taiwan Patent, publication No. I241157, and a U.S. Pat. No. 6,736,340B1, includes a control rod 30 with a neck 33 that is corresponded to a seal 20 equipped with outlets 21 and a saddle 25 so as to control the water discharge via the outlets 21 thereof. However, in operation, the body of the control rod 30 must be completely abutted and wrapped at the saddle 25 of the seal 20 thereon, which may increase the contact area between the rod body and the saddle 25 and thus augment the frictional coefficient thereby. As a result, a lot of efforts must be spent to push the control rod 30 in operation. Besides, the rod body and the saddle 25 contact with each other in arcuate abutment, which will increase the frictional resistance thereof. Therefore, in case of high water pressure, the strong current will flush along the periphery of the control rod 30 to buffet the inner side of the saddle 25 and infiltrate into the outlets 21 via the chinks between the rod body and the saddle 25 thereof, which makes the control rod 30 ineffective to avoid leaking in case of high water pressure.

SUMMARY OF THE PRESENT INVENTION

It is, therefore, the primary purpose of the present invention to provide a water shutoff and discharge control device for sprinklers wherein multiple control shafts each having a plug mounted thereto are utilized to match to a sealing strip having water-sealing areas disposed thereon, and a movement space is revealed between each plug and the water-sealing area so that the control shaft can be smoothly slid in an easy manner; even when the control shaft is moved in the state of water discharge, the plug is simply abutted against the water-sealing area, reducing the contact area between the control shaft and the sealing strip and, thus, cutting down the frictional coefficient there-between for more efforts-saving operation of the control shaft thereby.

It is, therefore, the second purpose of the present invention to provide a water shutoff and discharge control device for sprinklers wherein the plug, the base of the sealing strip, and the internal wall of a platform of a tube are respectively defined by a flat abutment surface so that, when flushed by strong current, the plug is reinforced to close upwards and watertight onto the water-sealing area of the sealing strap and synchronically push a water-sealing ring of the base thereof to abut tight against an internal plane surface of the platform thereon, precisely avoiding the risk of water leaking through spray nozzles or bores to achieve better waterproof effect no matter in high or low water pressure thereof.

DETAILED DESCRIPTION OF THE PREFERRED EMBODIMENTS

Figure 1:
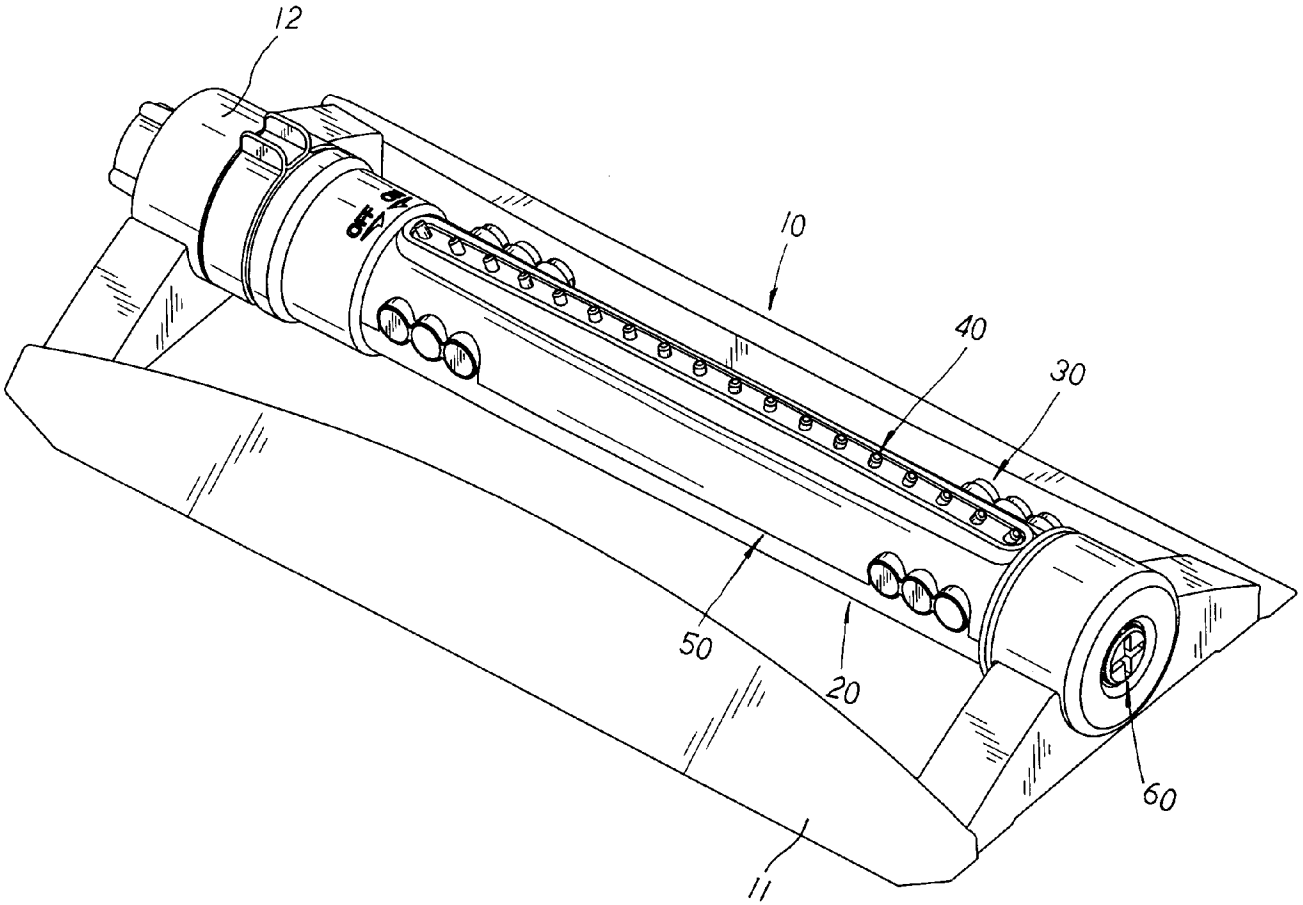
FIG. 1 is a perspective view of a sprinkler of the present invention.
Figure 2:
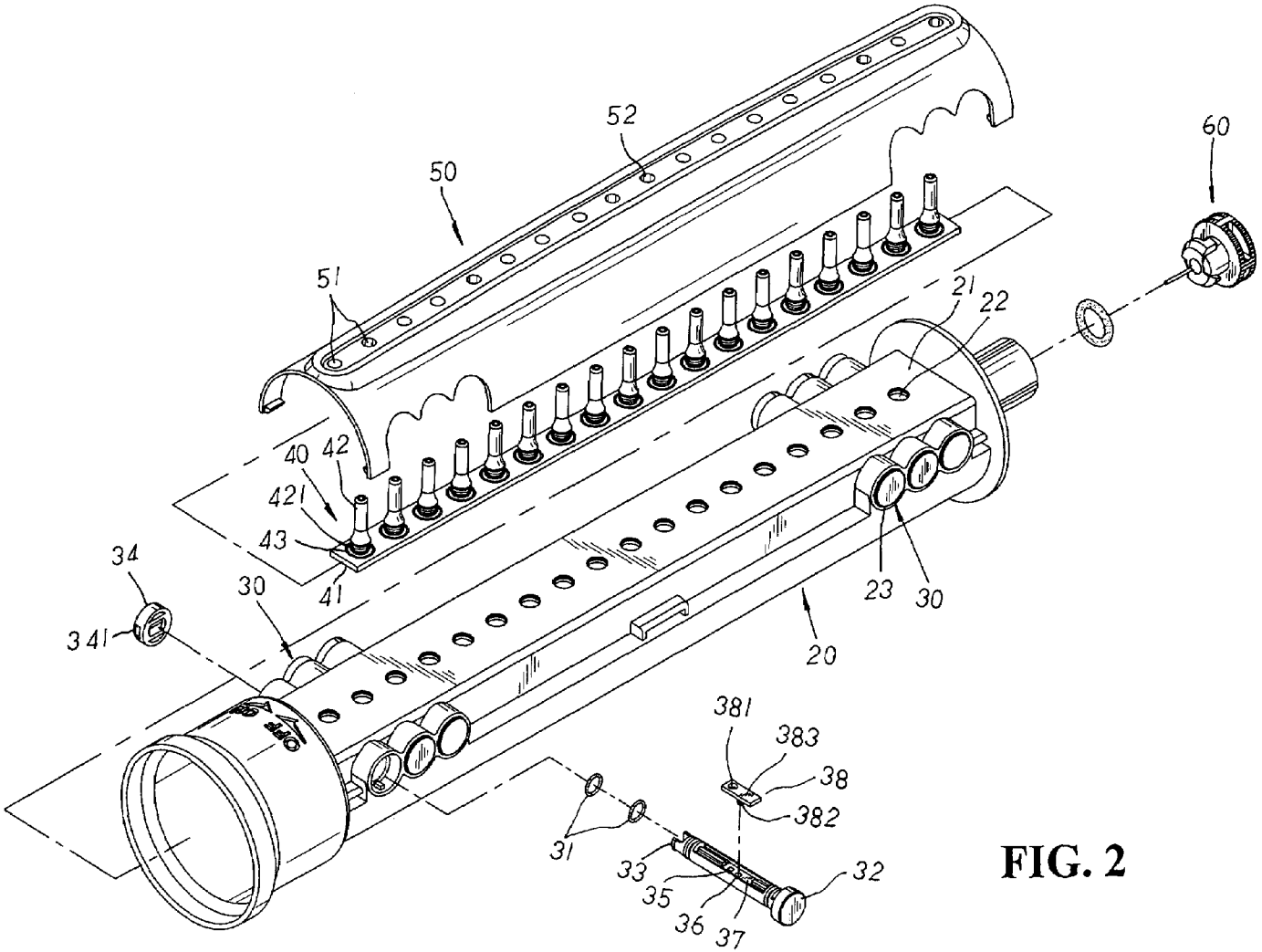
FIG. 2 is an exploded perspective view of the present invention.
Figure 3:
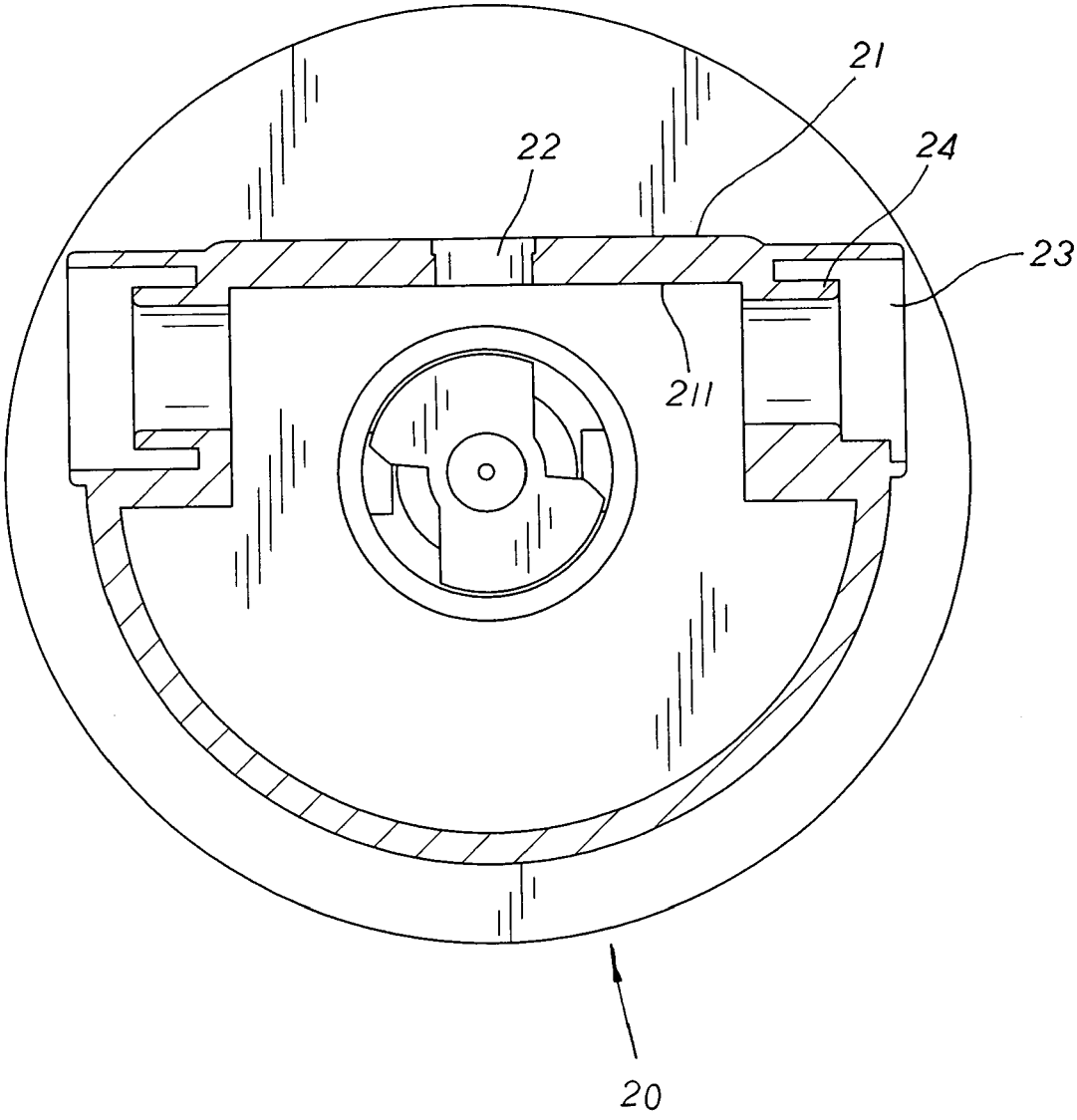
FIG. 3 is a cross sectional view of a tube of the present invention.
Figure 4:
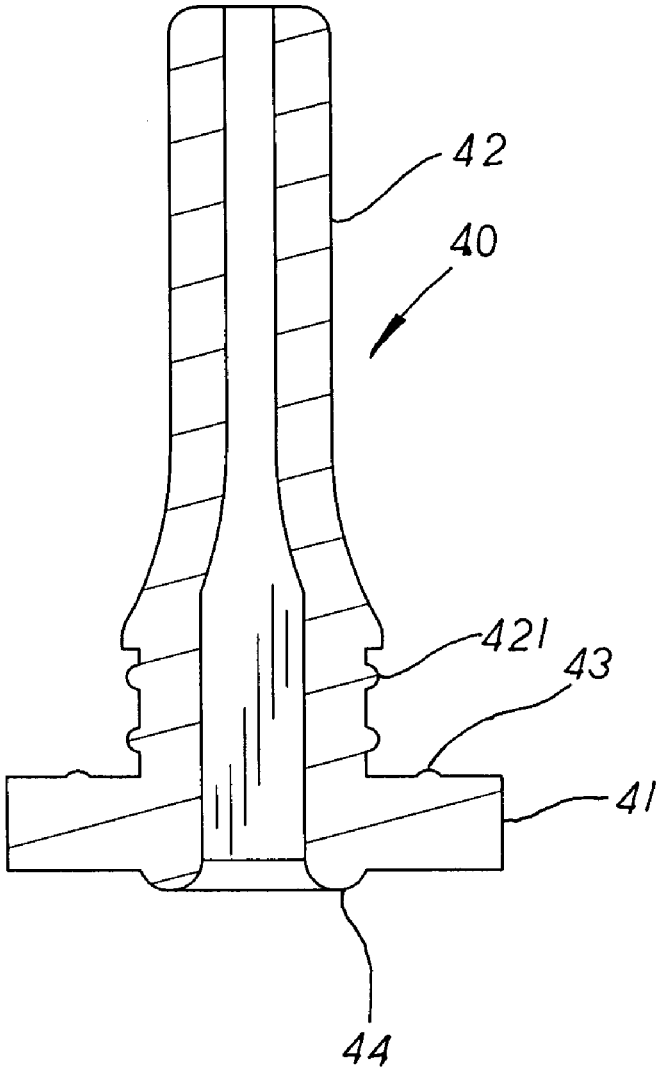
FIG. 4 is a cross sectional view of a sealing strip of the present invention.
Figure 5:
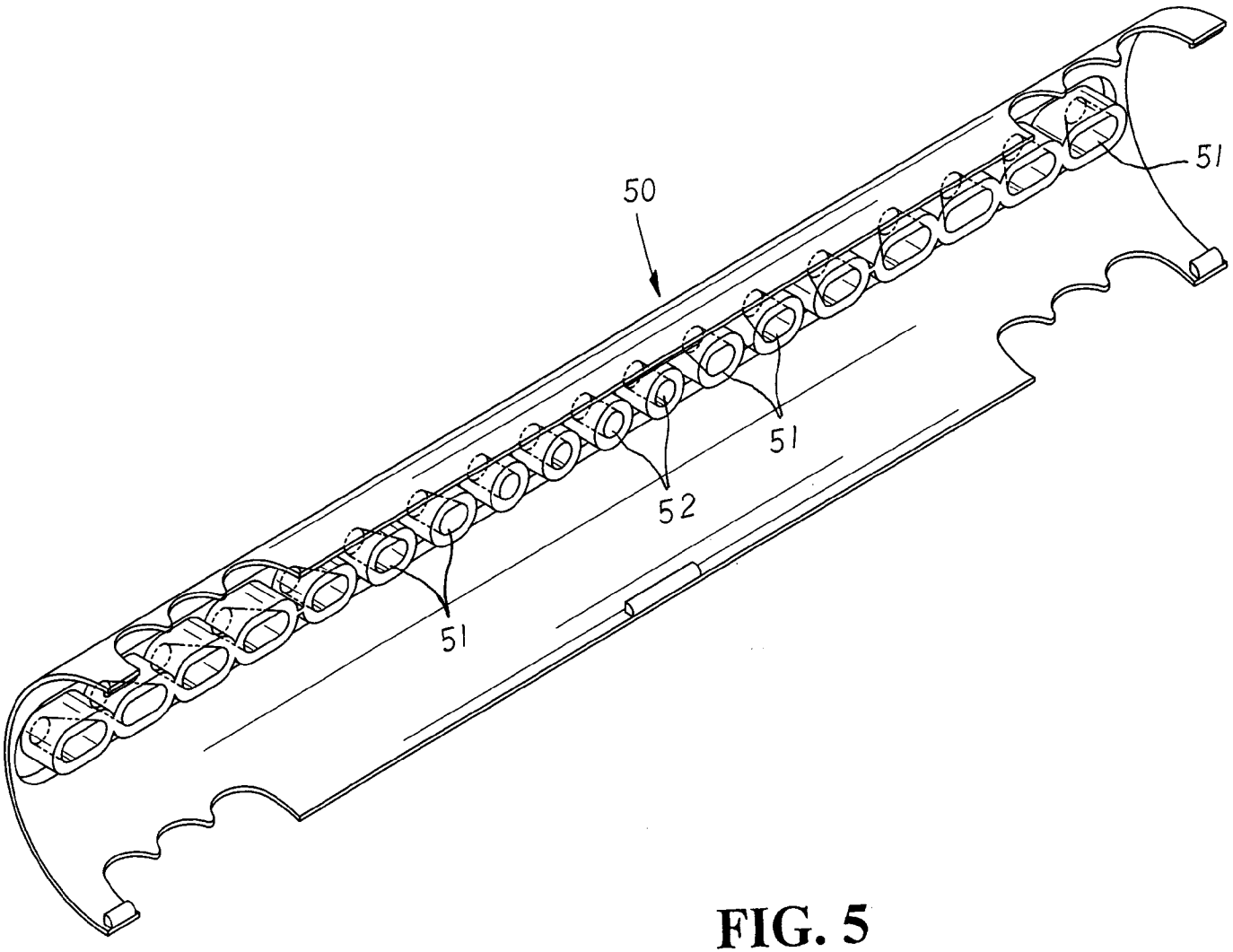
FIG. 5 is a perspective view of a nozzle housing taken from the internal side thereof.

Please refer to FIG. 1 showing a perspective view of the present invention (accompanied by FIG. 2). The present invention relates to a water shutoff and discharge control device for sprinklers, comprising a sprinkler 10, and a water intake assembly made up of a tube 20, multiple control shafts 30, a sealing strip 40, and a nozzle housing 50 to be transversely mounted to a support seat 11 thereon. A sprinkling control assembly 12 fluidly connected to the water supply is attached to one end of the water intake assembly to swing the water intake assembly back-and-forth into different angles, and a sealing cover 60 is jointed to the other end of the water intake assembly to form an enclosed end thereby. The tube 20 as shown in FIG. 3 has a top cut into a platform 21 with a plane surface 211 defining the internal wall thereon and a plurality of bores 22 drilled thereon. Both end sections of the platform 21 have multiple control channels 23 protruding thereon to communicate with the interior of the tube 20 thereof, and both internal end edges of each control channel 23 have a smaller-diameter stop ring 24 extending therein respectively. The control shaft 30, cut into a plane surface at both top and bottom sides thereon respectively, has an annular groove indented thereon at both end periphery thereon for the mounting of a sealing hoop 31 thereto, a larger-diameter limiting head 32 disposed at one end, and a pair of flexible insert legs 33 symmetrically extending at the other end to fit to a stop sheath 34 with insert holes 341 defining thereon. And, a restricting cavity 37 defined by an inlet orifice 35 and a guide orifice 36 thereon is indented at an appropriate position of the control shaft 30 thereon to correspond to a plug 38 therewith. The plug 38 is provided with an inlet aperture 381 and a guide rod 382 thereon, and an abutment surface 383 is preset to one side of the inlet aperture 381 thereon. The sealing strip 40 (referring to FIG. 4), molded by flexible plastic material into a belt-like shape, is equipped with a base 41. Multiple spray nozzles 42 each having a coupling section 421 disposed thereon are provided protruding on the top of the base 41 thereof, and around the outer periphery of each spray nozzle 42 on both top and bottom surfaces of the base 41 are respectively disposed a protrusive ringed and flexible water-sealing rings 43 and a water-sealing area 44 thereon. The nozzle housing 50 (referring to FIG. 5) is matched to the tube 20. And both end sections and the middle sections of the nozzle housing 50 are respectively disposed multiple oblique guide passages 51 symmetrically arranged to incline sequentially outwards to both sides, and multiple passageways 52 to correspond to the bores 22 of the tube 20 thereby.

Figure 6:
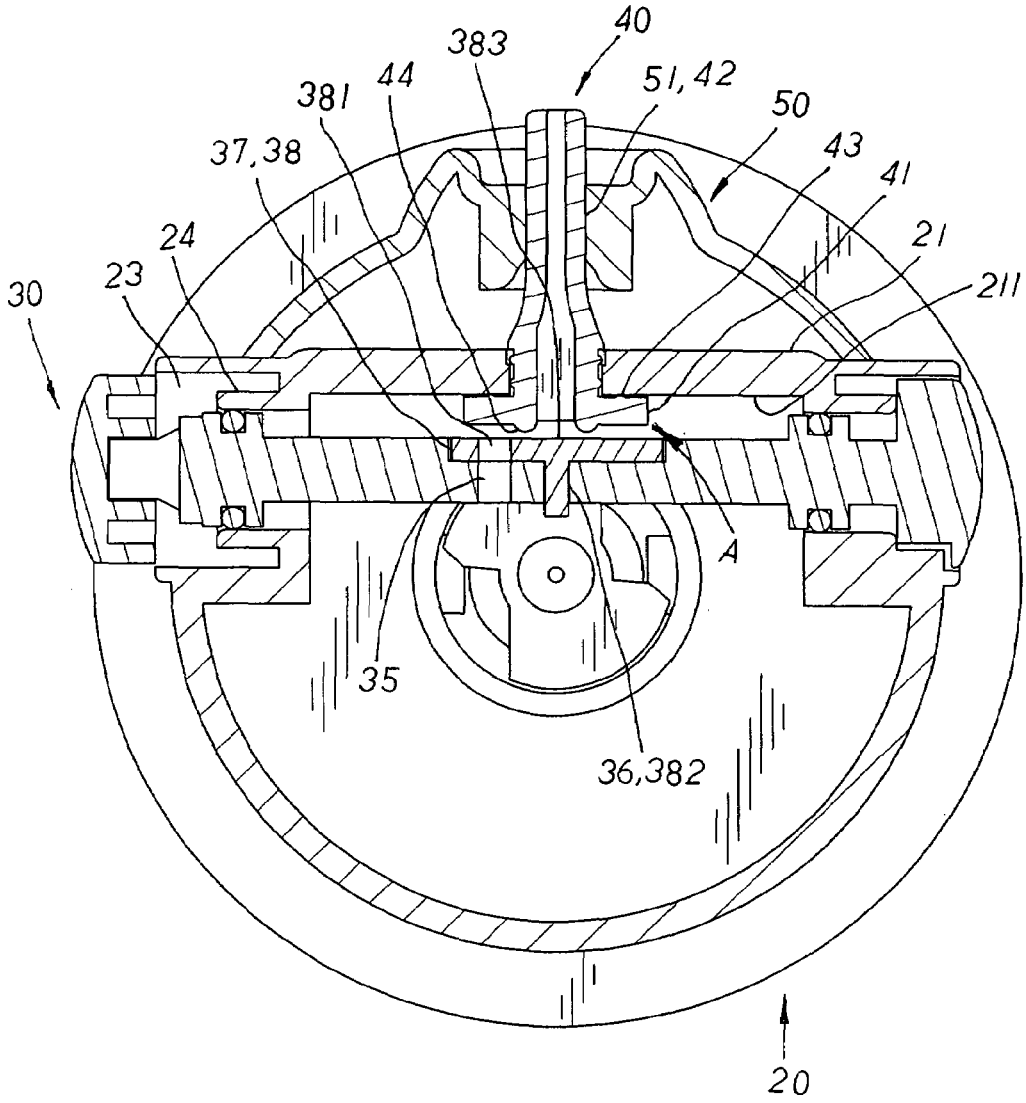
FIG. 6 is an assembled cross sectional view of the present invention.
Figure 7:
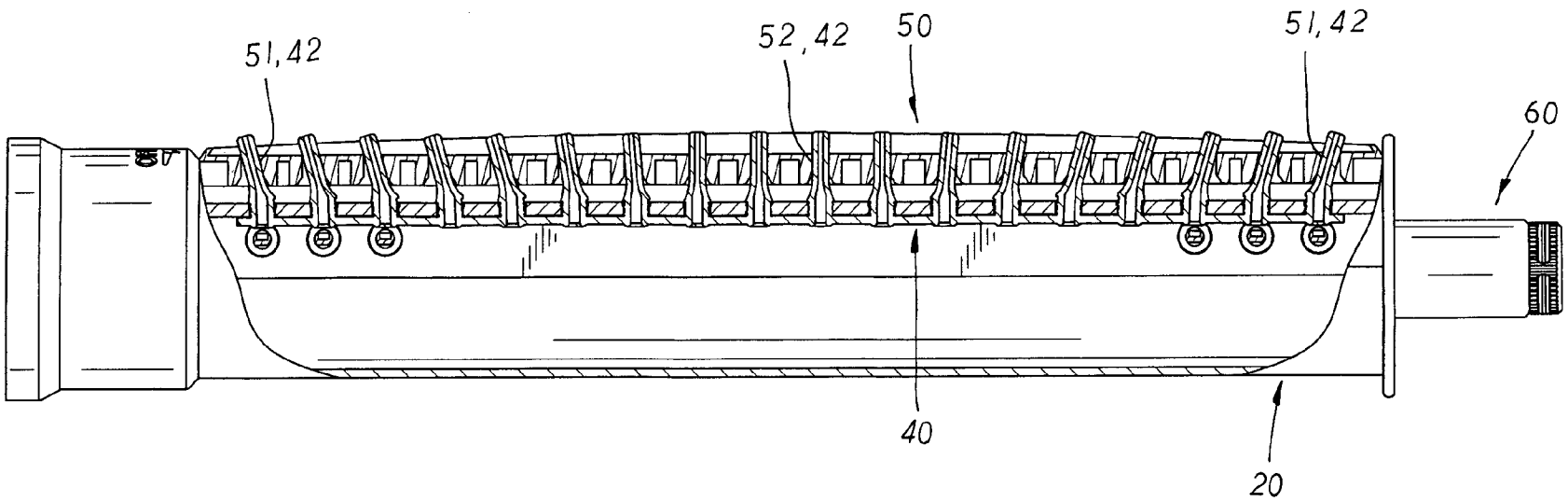
FIG. 7 is an assembled cross sectional view of the nozzle housing of the present invention mounted on top of the tube with spray nozzles guided to incline sequentially outwards at both sides thereof.

Please refer to FIG. 6. In assembly, each spray nozzle 42 of the sealing strip 40 is guided through the bores 22 of the tube 20 respectively till the coupling section 421 and the water-sealing ring 43 respectively abuts tight against the bore 22 and the plane surface 211 defining the internal wall of the platform 21 thereof. Then, the guide rod 382 of the plug 38 is joined to the guide orifice 36 of the control shaft 30, permitting the inlet orifice 35 and the inlet aperture 381 to correspondingly match to each other till the plug 38 is accommodated to the restricting cavity 37 therein so that the guide rod 382 can freely ascend or descend along the guide orifice 36 thereof. The flexible inert legs 33 of the control shaft 30 are guided from one end of the control channel 23 of the tube 20 to come out at the other end and mount to the insert holes 341 of the stop sheath 34 thereof so that the control shaft 30 is precisely restricted to move back-and-forth within the control channel 23 therein. Then, the sealing hoops 31 are abutted against the inner wall of the stop rings 24 thereof, and the stop sheath 34 and the limiting head 32 thereof are respectively restricted in position by the stop rings 24 according to the movement of the control shaft 30 thereof. Meanwhile, the base 41 of the sealing strip 40 is accurately situated between the platform 21 and the plug 38 of the control shaft 30, permitting an appropriate movement space A to reveal between the water-sealing area 44 and the plug 38 thereof. Then, the oblique guide passages 51 and the passageways 52 of the nozzle housing 50 are respectively guided to each spray nozzle 42 to cover the nozzle housing 50 downwards on top of the tube 20, permitting the spray nozzles 42 disposed at both sides thereof and bent by the angles of the oblique guide passages 51 to incline naturally outwards in a sequentially expanding manner as shown in FIG. 7.

Figure 8:
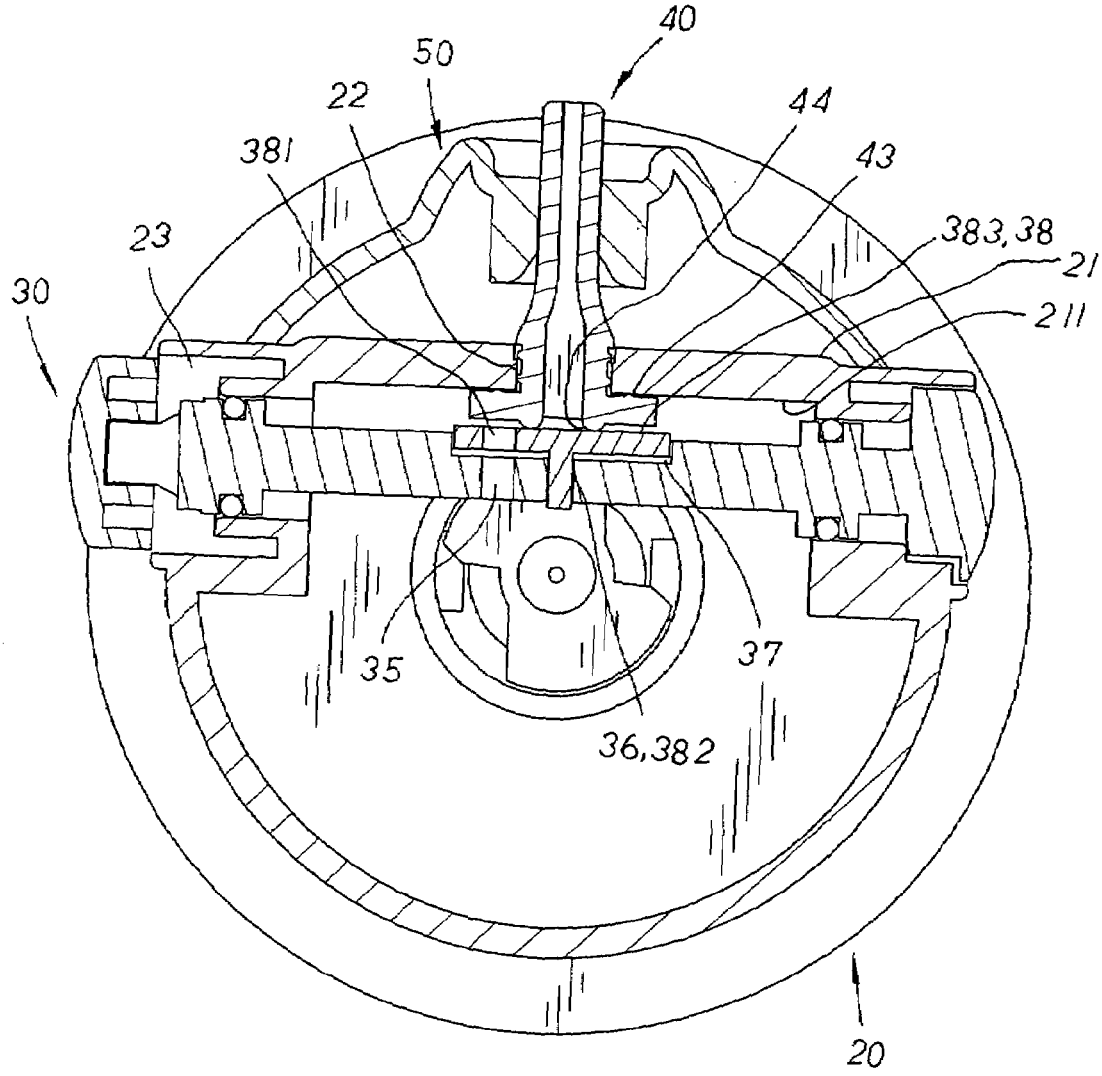
FIG. 8 is a diagram showing a plug of the present invention flushed by water flow to raise upwards to shut off the water discharge thereby.
Figure 9:
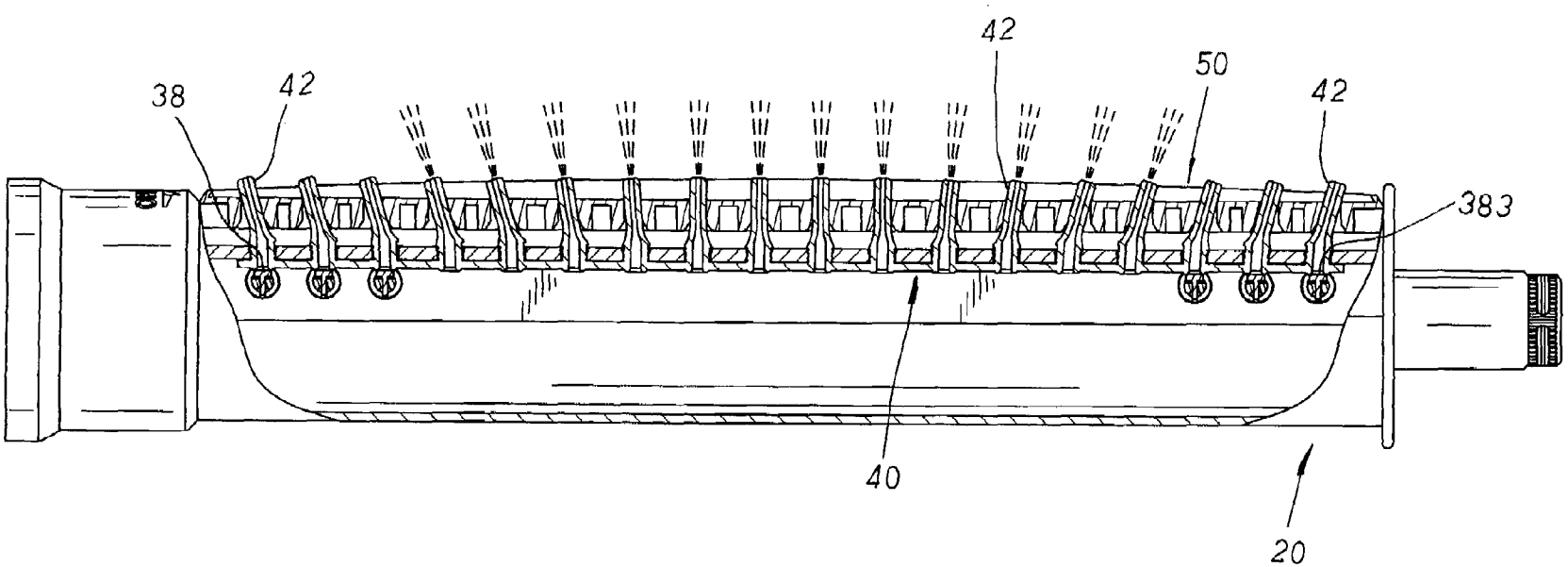
FIG. 9 is a diagram showing a reduced number of the spray nozzles for sprinkling as shown in FIG. 8.
Figure 10:
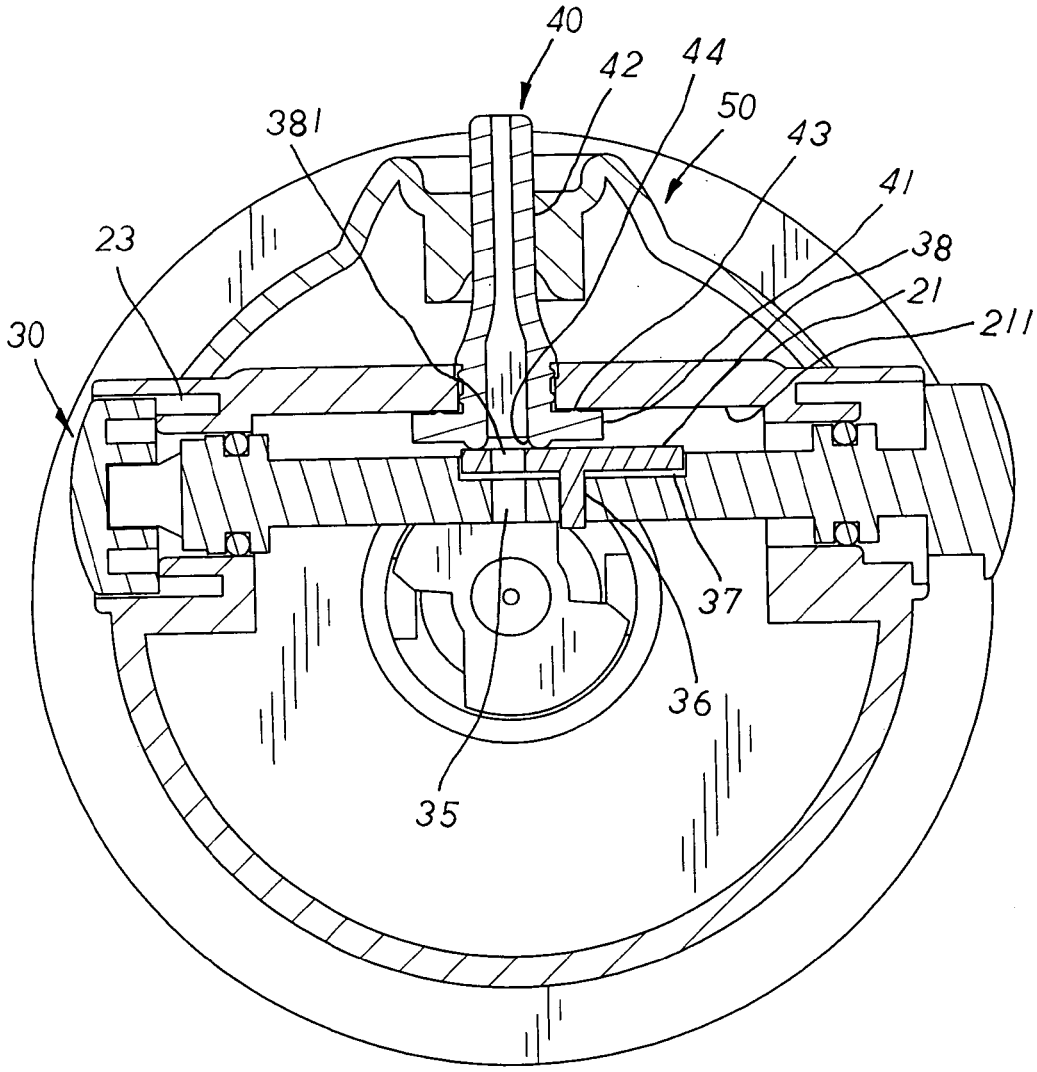
FIG. 10 is a diagram showing the plug of the present invention lifted upwards by water pressure in a state of water discharge.
Figure 11:
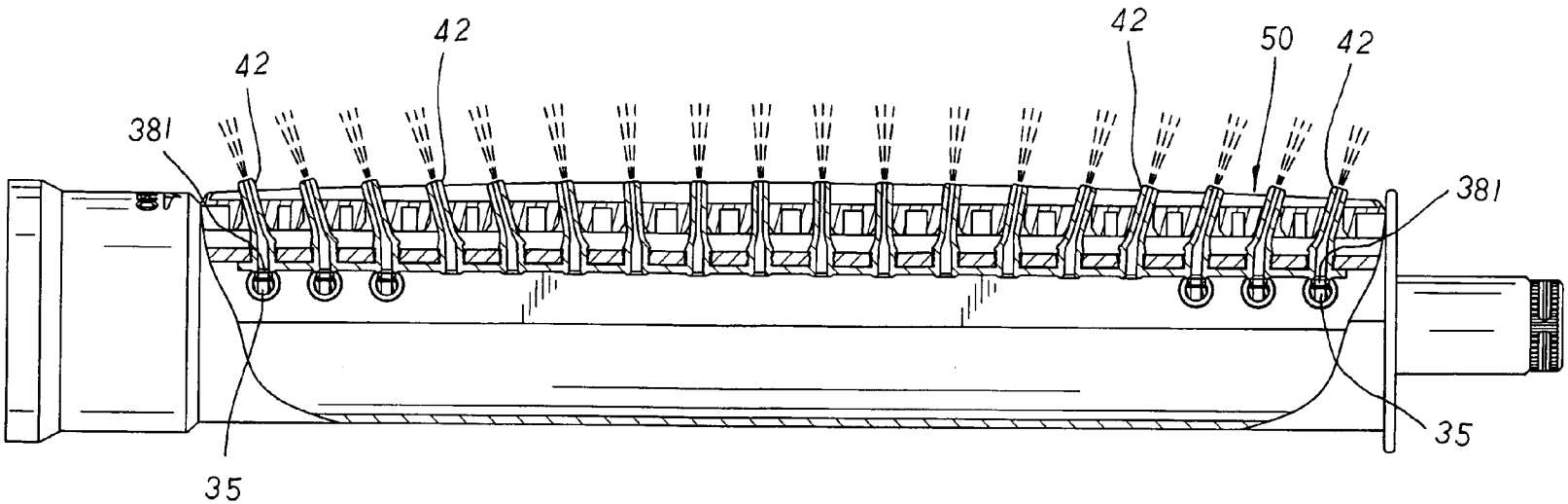
FIG. 11 is a diagram showing an increased number of the spray nozzles for sprinkling as shown in FIG. 10.

Please refer to FIG. 8. When water flow passes through the sprinkling control assembly 12 of the sprinkler 10 to enter the interior of the tube 20, pressure generated by the water flow will be transported through the inlet orifice 35 and the guide orifice 36 of the control shaft 30 to flush onto the plug 38, lifting the guide rod 382 to climb along the guide orifice 36 towards the movement space A till the abutment surface 383 contacts closely with the water-sealing area 44 of the sealing strip 40 so as to completely block the spray nozzle 42 and shut off the water discharge thereby, reducing the number of the spray nozzles 42 for sprinkling as shown in FIG. 9. To increase the number of the spray nozzles 42 for water discharge, the control shaft 30 is simply pushed to one side till the stop sheath 34 and the stop ring 24 are abutted against each other as shown in FIG. 10. Then, the abutment surface 383 of the plug 38 will be actuated by the control shaft 30 to synchronically slide along the water-sealing area 44, switching the inlet aperture 381 in position to precisely correspond to the spray nozzle 42 so as to open the spray nozzle 42 thereby. Thus, the water flow collected in the tube 20 therein will flow through the inlet orifice 35 of the control shaft 30 and the inlet aperture 381 of the plug 38 to emit outwards via the spray nozzle 42 thereof, increasing the number of the spray nozzles 42 for sprinkling as shown in FIG. 11 to achieve free and flexible change of the spray nozzles 42 in number for water discharge thereby. And, in addition to the passageways 52 extending in the middle section thereof, the oblique guide passages 51 are symmetrically arranged to incline outwards in a sequence at both sides of the nozzle housing 50, permitting the spray nozzles 42 disposed at both sides to bend naturally outwards in a sequentially expanding manner. In this way, the water flow ejected from both sides thereof can be guided by the oblique angles of the spray nozzles 42 to emit outwards from both sides in a dispersing manner so as to increase the sprinkling area in the distribution of water discharge. Meanwhile, the plug 38 of the control shaft 30 is flushed by the water pressure to lift upwards and abut close against the water-sealing area 44 of the sealing strip 40 so that the contact area between the control shaft 30 and the sealing strip 40 can be reduced, and the frictional coefficient therebetween is relatively cut down to allow a smoother and easier operation of the control shaft 30 thereby. Even in high water pressure, due to the flat abutment surface of the plug 38, the base 41 of the sealing strip 40, and the plane surface 211 defining the internal wall of the platform 21 of the tube 20, the plug 38 pressed by the strong water current will be further reinforced to abut watertight against the water-sealing area 44 and synchronically press the water-sealing ring 43 of the base 41 abutting closely against the internal plane surface 211 of the platform 21, efficiently preventing the water flow from leaking outwards through the spray nozzles 42 or the bores 22 in case of high water pressure thereof. Therefore, the control shaft 30 can achieve better waterproof effect no matter in high or low water pressure.

Figure 12:
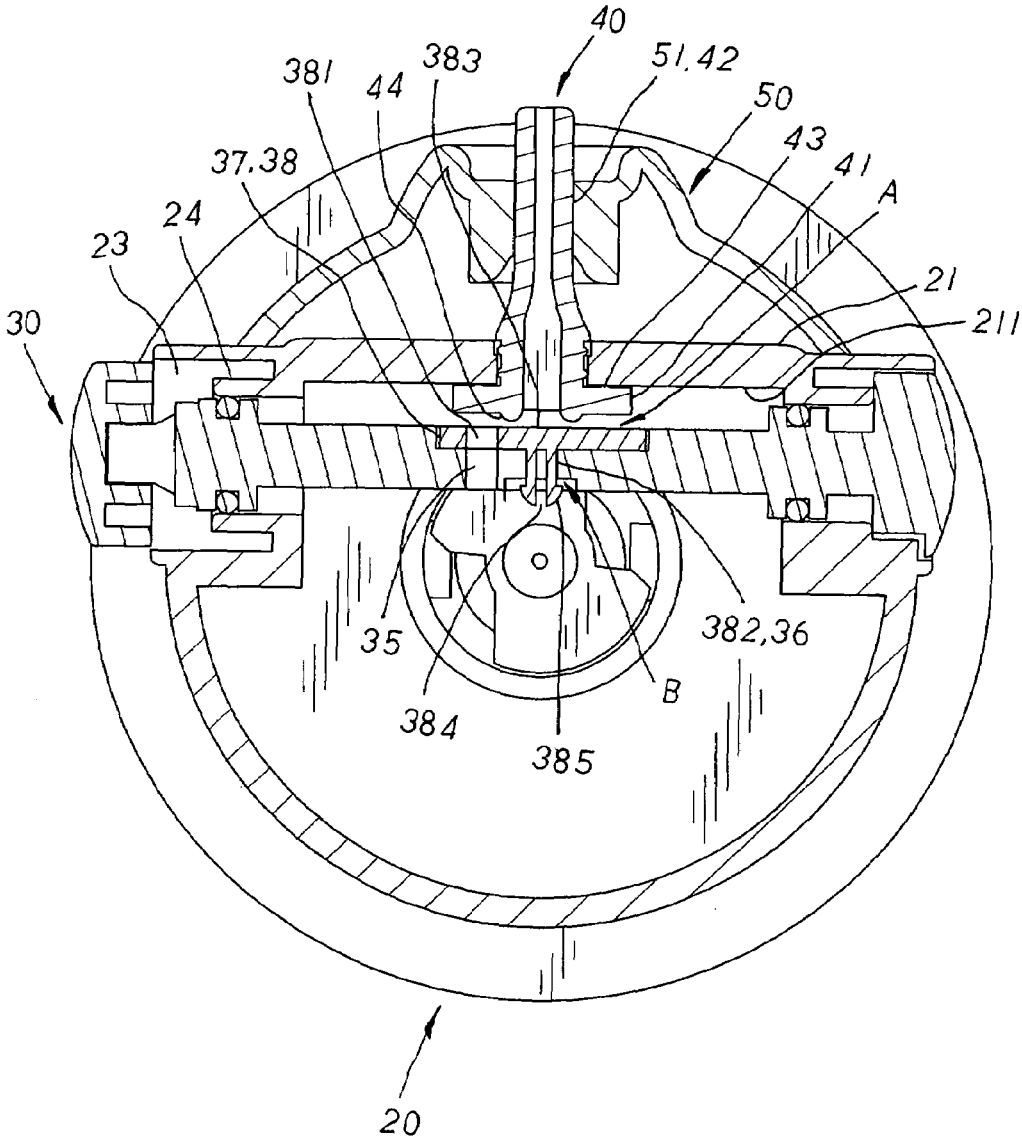
FIG. 12 is an assembled cross sectional view of another embodiment of the plug of the present invention.
Figure 13:
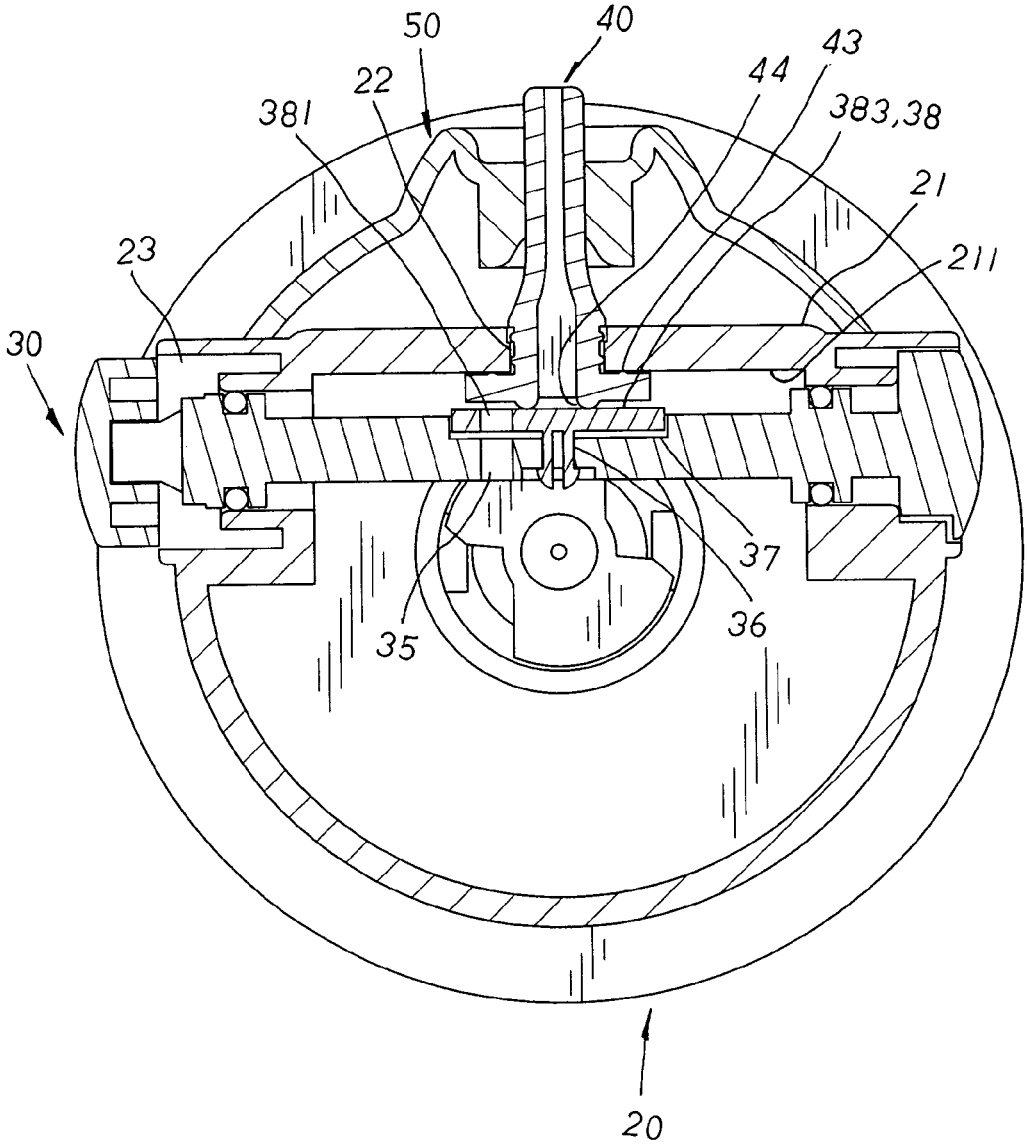
FIG. 13 is a diagram showing the plug of FIG. 12 flushed upwards by water pressure to shut off the water discharge thereby.
Figure 14:
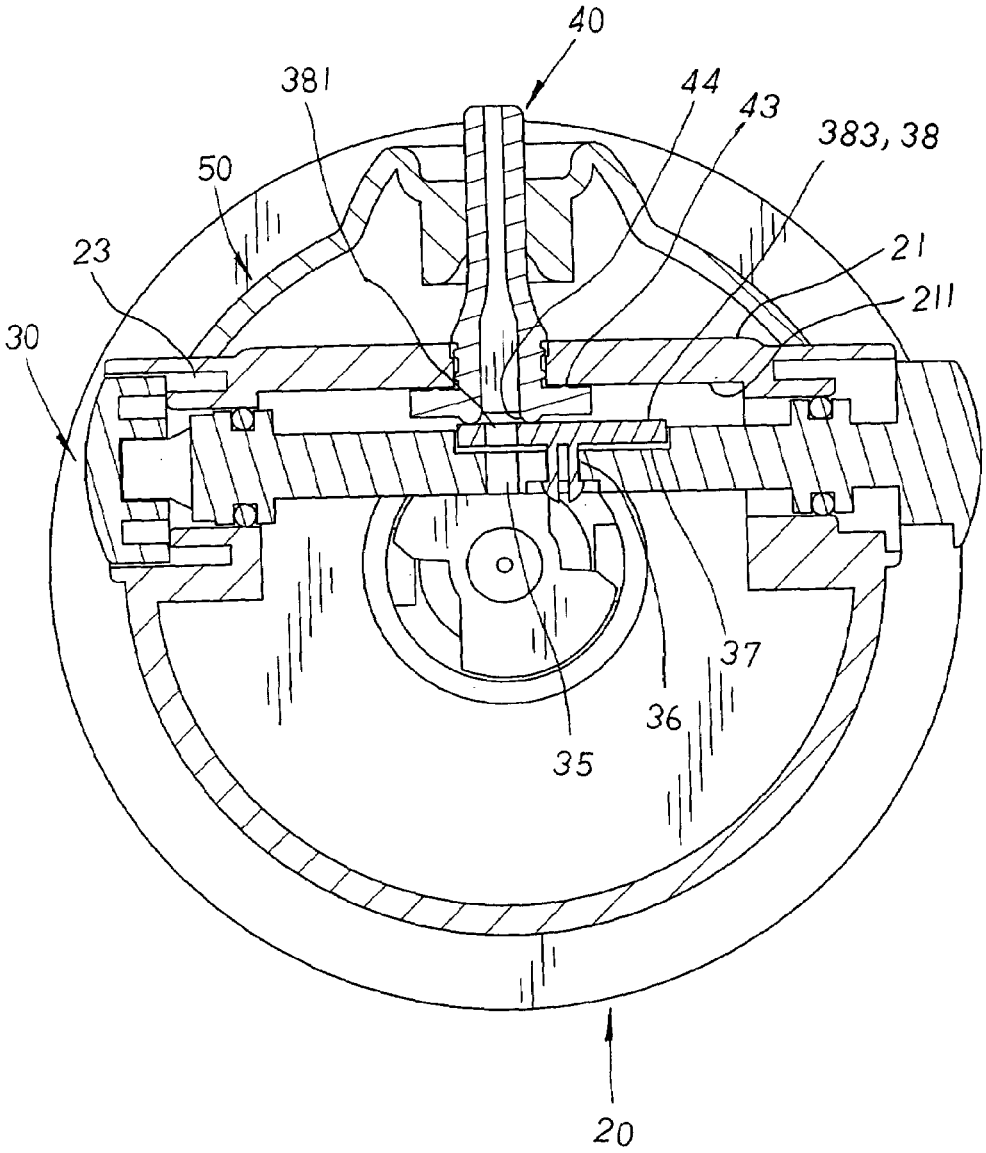
FIG. 14 is a diagram showing the plug of FIG. 12 flushed upwards by water pressure in a state of water discharge.

Please refer to FIG. 12 showing an assembled cross sectional view of another embodiment of the plug of the present invention. The plug 38 of the present invention can also have the guide rod 382 defined by a flexible cavity 384 therein, and an inverted hook 385 is disposed protruding at the end edge of the guide rod 382 thereon. The inverted hook 385 can be squeezed through the guide orifice 36 of the control shaft 30 and elastically pressed into the flexible cavity 384 thereof, permitting the inlet orifice 35 and the inlet aperture 381 to correspond to each other till the plug 38 is accommodated to the restricting cavity 37 therein. Then, an operational space B slightly larger than the movement space A is revealed between the inverted hook 385 and the bottom surface of the control shaft 30 thereby. And via the movement space A and the operational space B preset at both end sides of the plug 38, the guide rod 382 is allowed to freely ascend or descend along the guide orifice 36 thereby. When the water flow enters the tube 20 therein, the plug 38 flushed by the water pressure will be actuated to climb upwards towards the movement space A and the operational space B till the abutment surface 383 closely contacts with the water-sealing area 44 of the sealing strip 40 so as to completely block up the spray nozzle 42 and stop the water discharge in a shutoff state as shown in FIG. 13. Thus, the number of the spray nozzles 42 applied for sprinkling can be reduced in this manner. And, to increase the number of the spray nozzles 42 for sprinkling thereof, the control shaft 30 is simply pushed towards one side till the stop sheath 34 abuts against the stop ring 24 as shown in FIG. 14. Meanwhile, the abutment surface 383 of the plug 38 is actuated by the movement of the control shaft 30 to synchronically slide along the water-sealing area 44, permitting the inlet aperture 381 to precisely correspond to the spray nozzle 42 so as to open the spray nozzle 42 for the water flow collected at the tube 20 therein to flow through the inlet orifice 35 of the control shaft 30 and the inlet aperture 381 of the plug 38 and eject outwards through the opened spray nozzle 42. Thus, the spray nozzles 42 can be easily augmented in number for water discharge, achieving flexible and free change of the spray nozzles 42 in number for sprinkling thereby.

Figure 15:
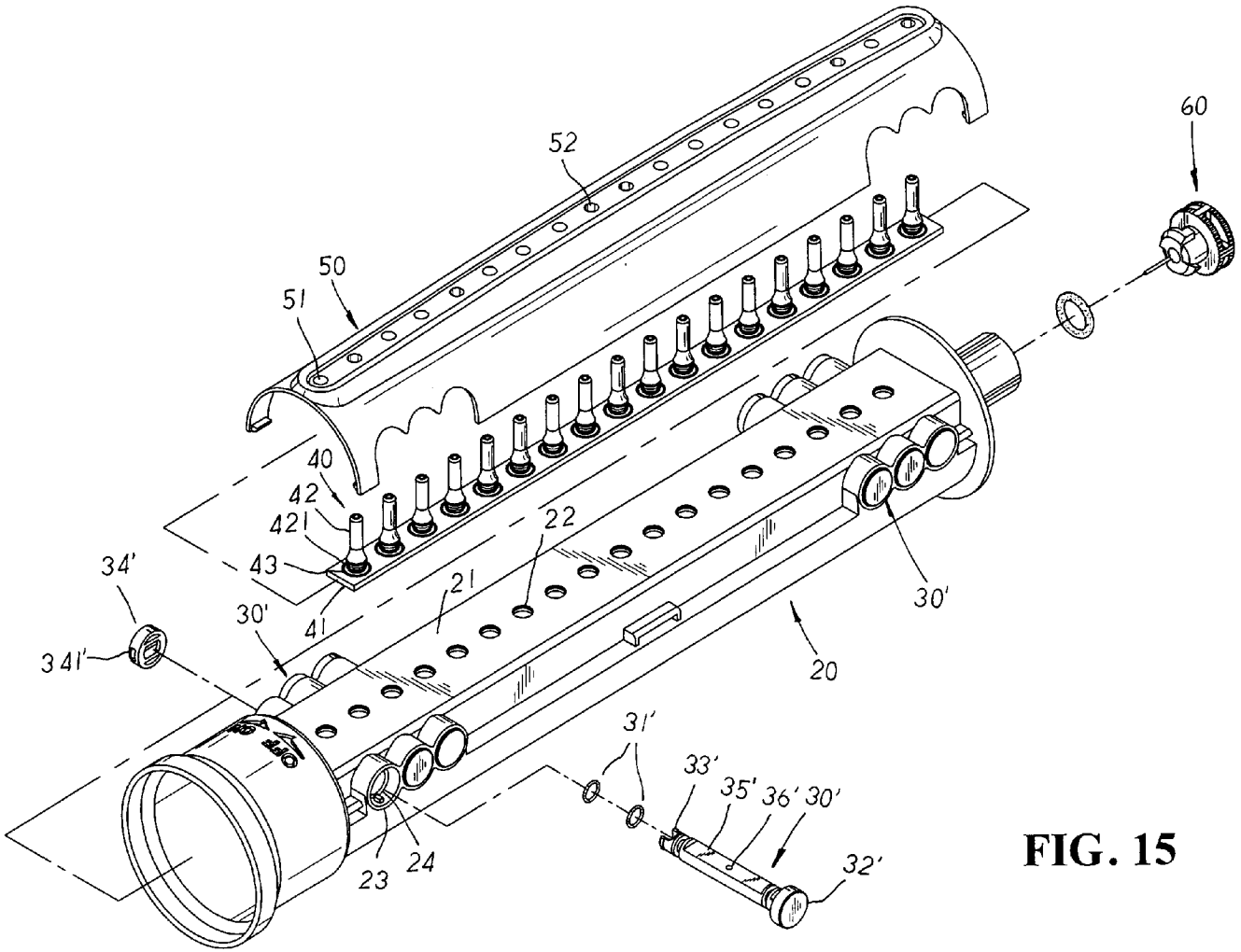
FIG. 15 is an exploded perspective view of another embodiment of the present invention.
Figure 16:
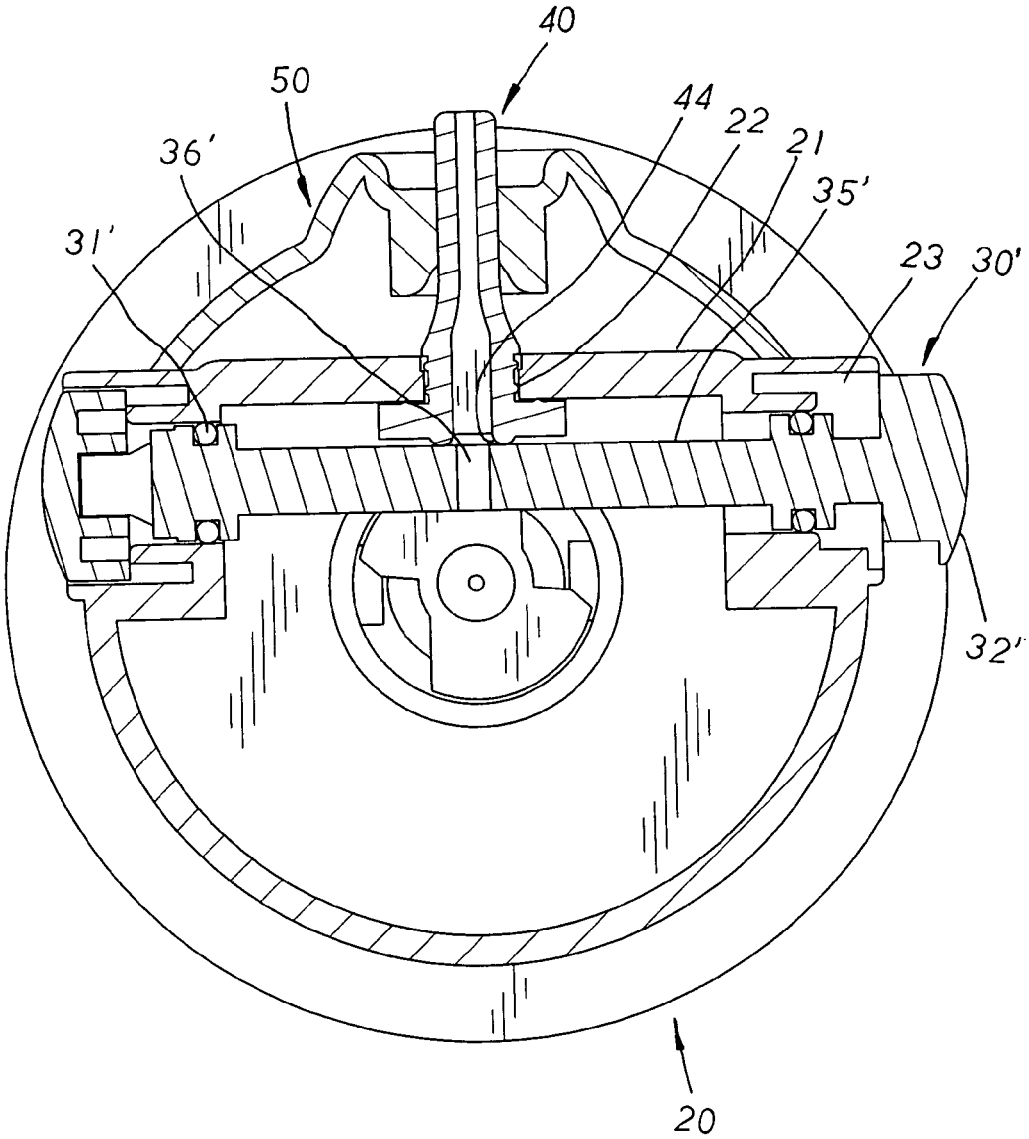
FIG. 16 is an assembled flat view of another embodiment of the present invention as shown in FIG. 15 in a state of water discharge.
Figure 17:
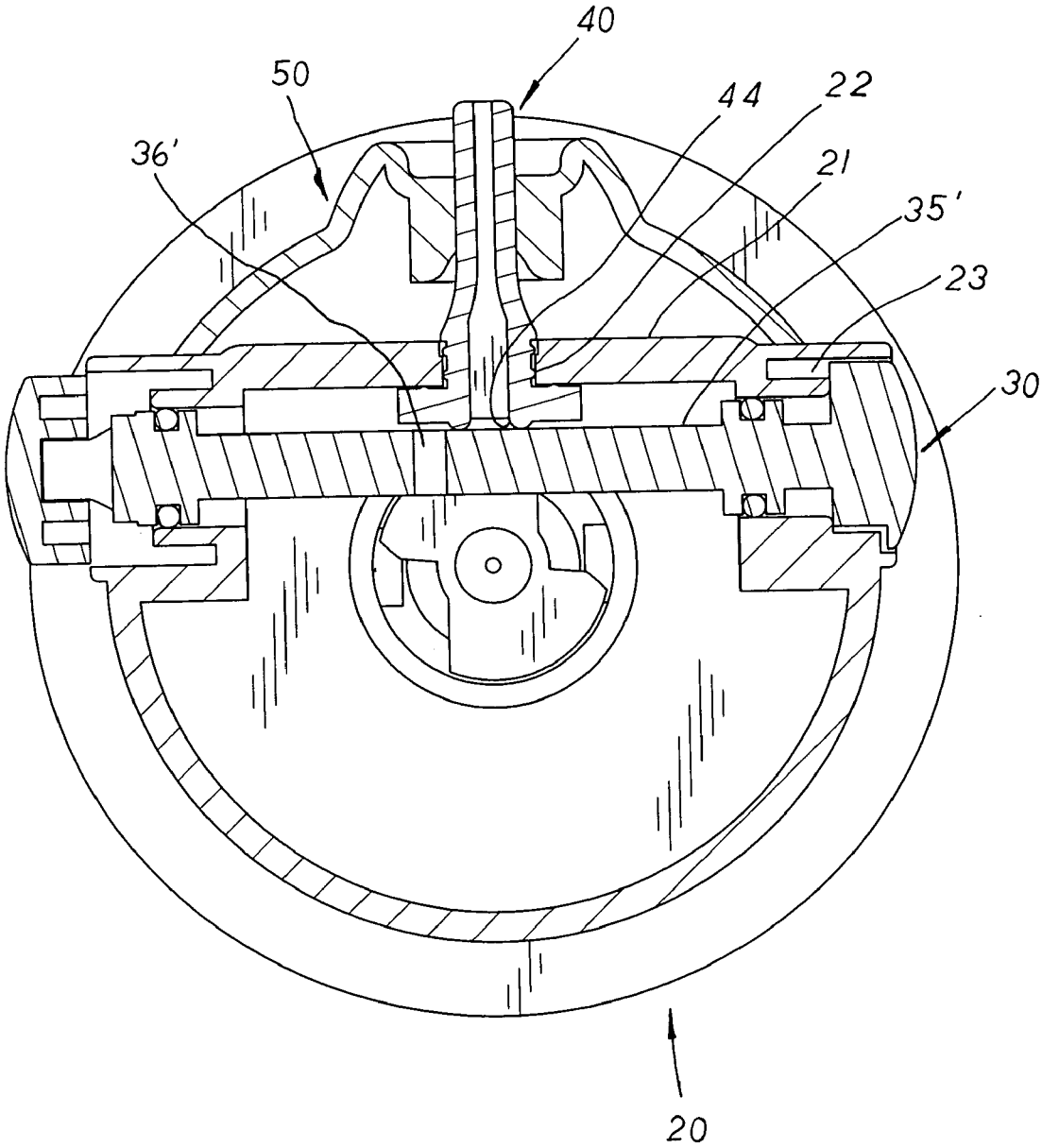
FIG. 17 is an assembled flat view of another embodiment of the present invention as shown in FIG. 15 in a state of water shutoff.

Please refer to FIG. 15 showing an exploded perspective view of another embodiment of the present invention. The present invention can also include multiple control shafts 30' each having both end sections defined by an annular groove for the accommodation of a sealing hoop 31' thereon. One end of the control shaft 30' is equipped with a larger-diameter limiting head 32', and the other end thereof has a pair of flexible insert legs 33' symmetrically extending thereon to fit to a stop sheath 34' defined by insert holes 341' thereon. A flat surface 35' is levelly cut between the two sealing hoops 31' to precisely abut tight against the water-sealing area 44 of the sealing strip 40 thereby. The flat surface 35' of the control shaft 30' has a hole-like water-intake area 36' indented at an appropriate position thereon, and is allowed to slide along the water-sealing area 44 and move back-and-forth within the control channel 23 of the tube 20 so as to reduce the contact area there-between for more efforts-saving operation of the control shaft 30' thereby. Thus, when the water-intake area 36' is situated within the water-sealing area 44 and precisely matched to the spray nozzle 42 as shown in FIG. 16, the water flow collected in the tube 20 thereof will flush through the water-intake area 36' to emit outwards via the spray nozzle 42 thereof. And, when the control shaft 30' is slid towards the other side thereof, the water-intake area 36' will be switched in position to detach from the spray nozzle 42 till the water-sealing area 44 completely and evenly closes onto the flat surface 35' as shown in FIG. 17. Then, the spray nozzle 42 will be blocked up to shut off the water discharge, and the spray nozzles 42 for sprinkling can be easily reduced in number, achieving control of water discharge thereby.

Figure 18:
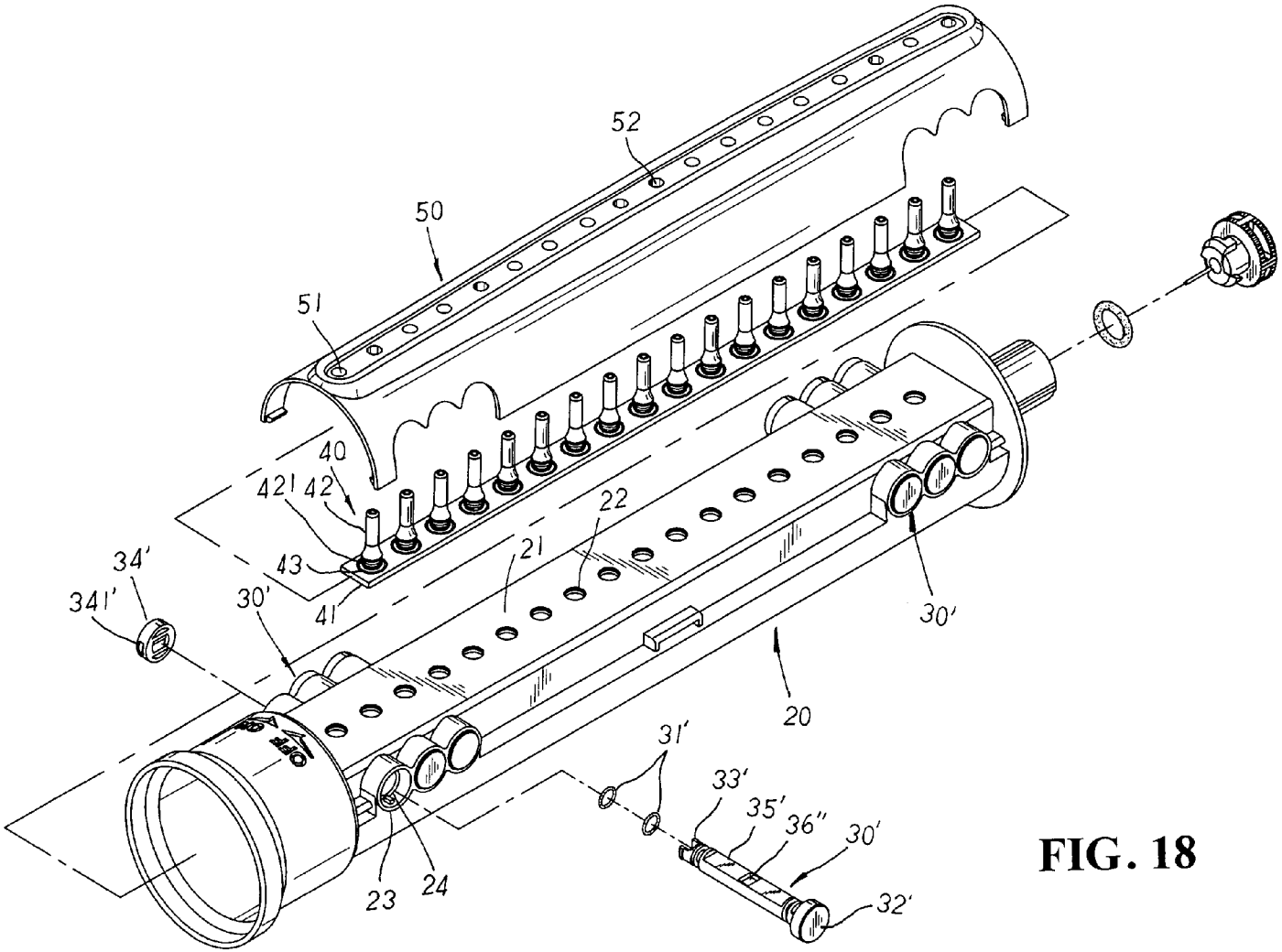
FIG. 18 is an exploded perspective view of a third embodiment of the present invention.
Figure 19:
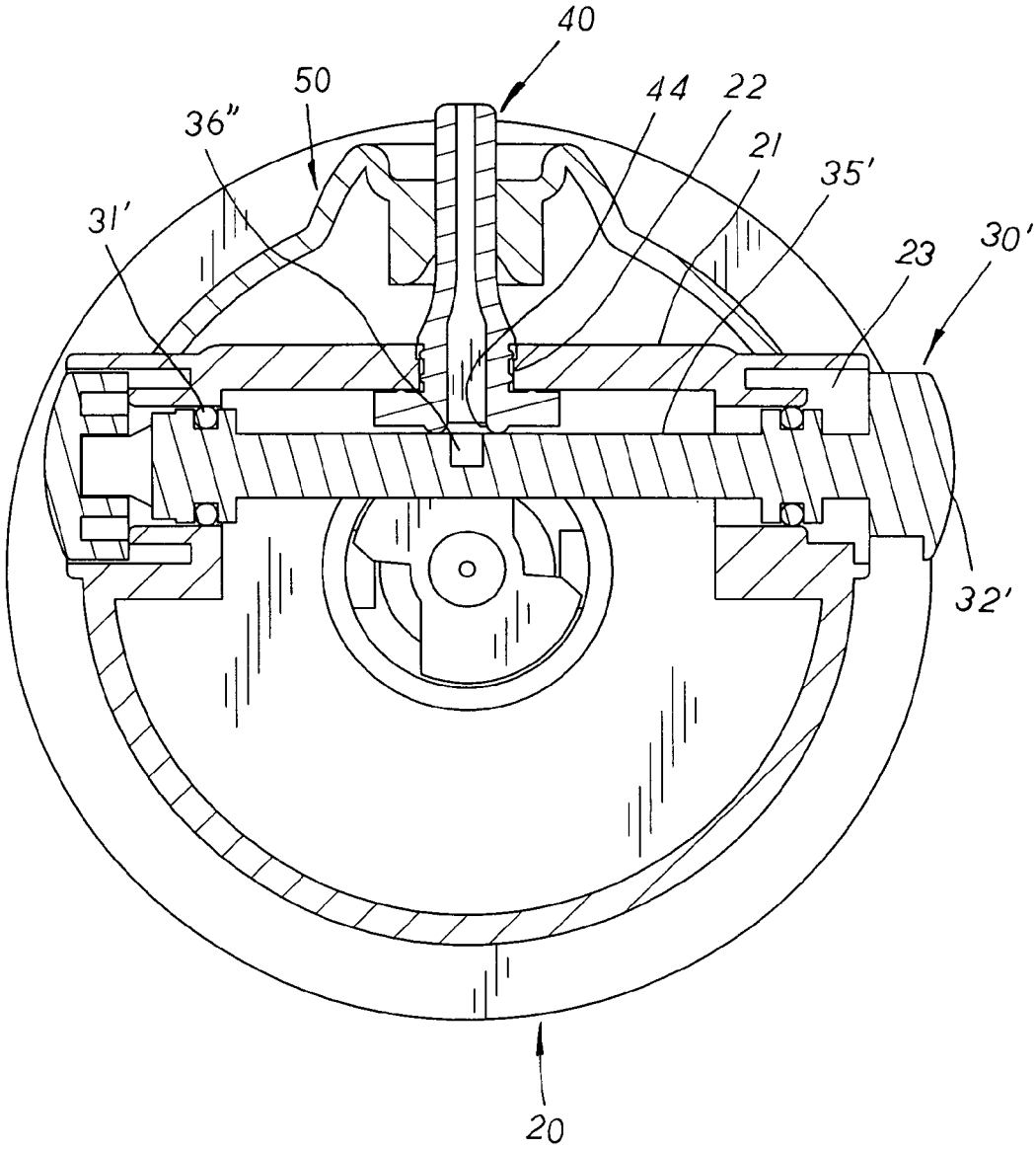
FIG. 19 is an assembled flat view of the third embodiment of the present invention as shown in FIG. 18 in a state of water discharge.
Figure 20:
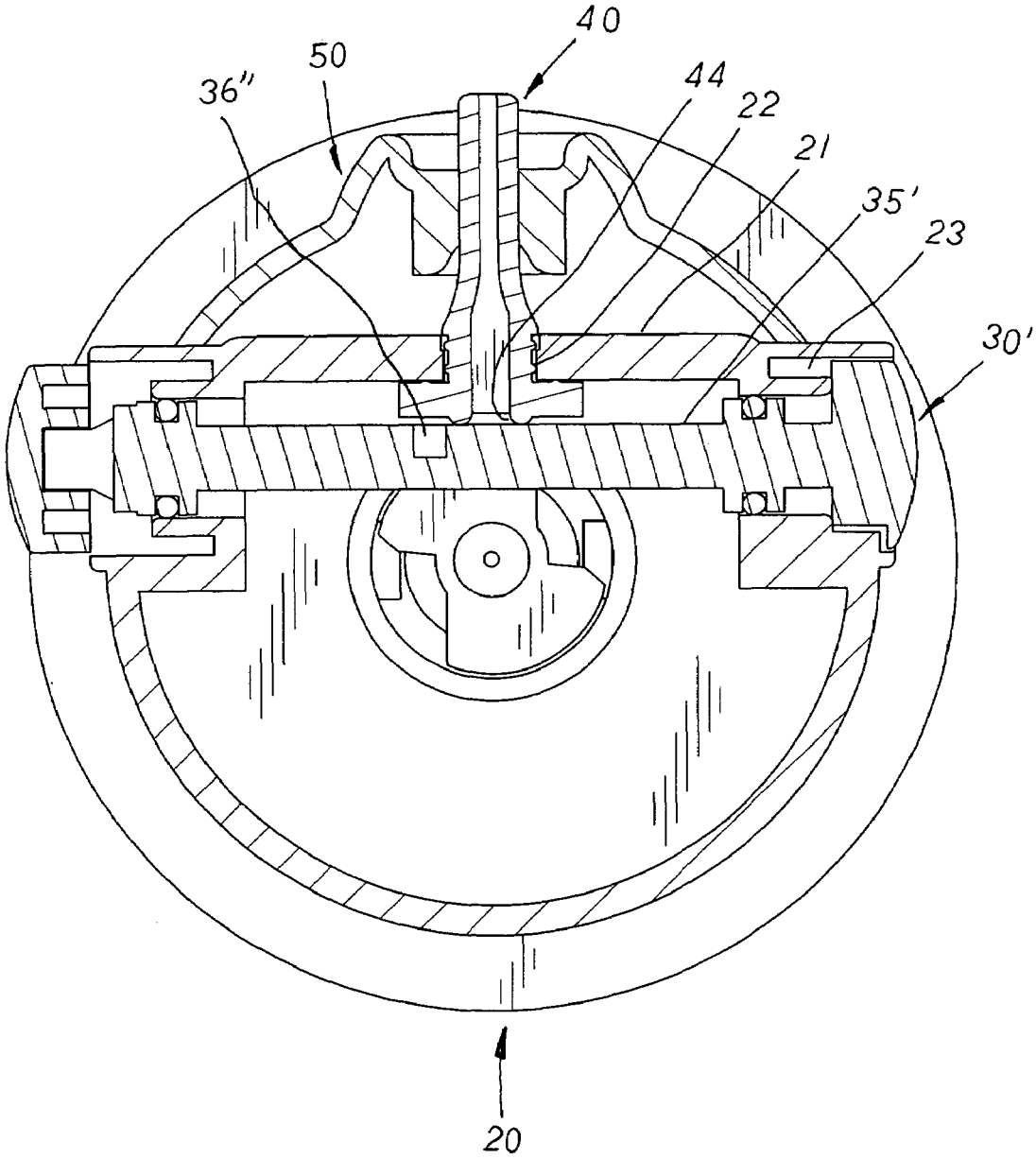
FIG. 20 is an assembled flat view of the third embodiment of the present invention as shown in FIG. 18 in a state of water shutoff.

Please refer to FIG. 18 showing an exploded perspective view of a third embodiment of the present invention. The present invention can also include multiple control shafts 30' each having both end sections defined by an annular groove for the accommodation of a sealing hoop 31' thereon. One end of the control shaft 30' is equipped with a larger-diameter limiting head 32', and the other end thereof has a pair of flexible insert legs 33' symmetrically extending thereon to reciprocally match to a stop sheath 34' defined by insert holes 341' thereon. A flat surface 35' is levelly cut between the two sealing hoops 31' to precisely abut tight against the water-sealing area 44 of the sealing strip 40 thereby. The flat surface 35' of the control shaft 30' has a groove-like water-intake area 36" indented at an appropriate position thereon, and is allowed to slide along the water-sealing area 44 and move back-and-forth within the control channel 23 of the tube 20 so as to reduce the contact area there-between for more efforts-saving operation of the control shaft 30' thereby. When the water-intake area 36" is situated within the water-sealing area 44 and precisely matched to the spray nozzle 42 as shown in FIG. 19, the water flow collected in the tube 20 thereof will flush through the water-intake area 36" to emit outwards via the spray nozzle 42 thereof. And, when the control shaft 30' is slid towards the other side thereof, the water-intake area 36" will be switched in position to detach from the spray nozzle 42 till the water-sealing area 44 completely and evenly closes onto the flat surface 35' as shown in FIG. 20. Then, the spray nozzle 42 will be blocked up to shut off the water discharge so as to reduce the number of the spray nozzles 42 for sprinkling, achieving control of water discharge in an easy manner thereby.

What is claimed is:

1. A water shutoff and discharge control device for sprinklers, comprising a sprinkler wherein a water intake assembly is equipped with a tube having a top side defined by a platform, and the platform has a plane surface defining the internal wall and a plurality of bores drilled thereon for the mounting of a sealing strip equipped with a plurality of spray nozzles and a base; a water-sealing ring and a water-sealing area are respectively disposed protruding around an outer periphery of each said spray nozzle on a top and bottom surface of the base thereof, and the water-sealing ring is closely abutted against the internal plane surface of the platform; on, both end sides of the platform are disposed multiple control channels each communicating with the tube for the extension of a control shaft there-through with a plug mounted thereto; wherein the water shutoff and discharge control device for sprinklers is characterized by that the plug is situated to precisely correspond to the water-sealing area of the sealing strip with a movement space preset there-between, and on both sides of the plug are respectively disposed an inlet aperture and an abutment surface, permitting the plug flushed by the water flow to climb upwards and abut tight against the water-sealing area; therefore, depending on the sliding movement of the control shaft, the inlet aperture and the abutment surface of the plug will be switched in position to respectively correspond to the spray nozzle thereof, achieving control of water shutoff and discharge; whereby the control shaft can be smoothly slid in an easy manner; even when the control shaft is moved in the state of water discharge, the plug is abutted against the water-sealing area, reducing the contact area between the control shaft and the sealing strip and, thus, cutting down the frictional coefficient there-between for more efforts-saving operation of the control shaft.

2. The water shutoff and discharge control device for sprinklers as claimed in claim 1 wherein each control channel of the tube has a smaller-diameter stop ring extending at the internal side of both ends therein respectively.

3. The water shutoff and discharge control device for sprinklers as claimed in claim 1 wherein each control shaft has both top and bottom sides cut into a flat surface respectively, and a restricting cavity indented at an appropriate position thereon for the accommodation of the plug therein; the restricting cavity has an inlet orifice disposed thereon to correspond to the inlet aperture of the plug thereby.

4. The water shutoff and discharge control device for sprinklers as claimed in claim 3 wherein the restricting cavity of the control shaft has a guide orifice disposed thereon for the extension there-through of a guide rod protruding on the bottom surface of the plug, permitting the guide rod of the plug to move up and down along the guide orifice thereof.

5. The water shutoff and discharge control device for sprinklers as claimed in claim 4 wherein the guide rod of the plug can have a flexible cavity defining therein, and an inverted hook preset at the bottom end thereon to extend outwards around the bottom surface of the control shaft with an appropriate operational space revealed there-between.

6. The water shutoff and discharge control device for sprinklers as claimed in claim 1 wherein the water-sealing rings and the water-sealing areas of the sealing strip are respectively molded in a protrusive ringed shape with a flexible capability.

7. The water shutoff and discharge control device for sprinklers as claimed in claim 1 wherein each spray nozzle of the sealing strip is equipped with a flexible and plastic coupling section to fit to one bore of the tube thereof.

8. The water shutoff and discharge control device for sprinklers as claimed in claim 1 wherein the control shaft has an annular groove defining both end sections thereon for the mounting of a sealing hoop thereto respectively, a larger-diameter limiting head disposed at one end, and a pair of flexible insert legs symmetrically extending at the other end thereon to fit to a stop sheath with insert holes defining thereon.

9. The water shutoff and discharge control device for sprinklers as claimed in claim 1 wherein the tube has a nozzle housing mounted to the top side thereon, and both end sections and the middle sections of the nozzle housing are respectively disposed multiple oblique guide passages symmetrically arranged to incline sequentially outwards to both sides, and multiple passageways to correspond to the bores of the tube and the spray nozzles of the sealing strip thereby, permitting the spray nozzles arranged at both sides thereof to naturally bend outwards in a sequentially expanding manner so that the water flow ejected from both sides is guided by the oblique angles of the spray nozzles to emit outwards in a dispersing manner, efficiently increasing the sprinkling area in the distribution of water discharge.

10. A water shutoff and discharge control device for sprinklers wherein a sprinkler comprises a water intake assembly transversely mounted to a support seat thereon and actuated by a sprinkling control assembly to swing back-and-forth into different angles; the water intake assembly is equipped with a tube having a top side defined by a platform, and the platform has a plane surface defining the internal wall and a plurality of bores drilled thereon for the mounting of a sealing strip equipped with a plurality of spray nozzles and a base; around the outer periphery of each spray nozzle on the top and bottom surfaces of the base thereof are respectively disposed a water-sealing ring and a water-sealing area, and the water-sealing ring is abutted watertight against the internal plane surface of the platform therewith; on, both end sides of the platform are disposed a plurality of control channels each connecting to the interior of the tube for the extension of a control shaft there-through; the control shaft has a flat surface levelly cut thereon to precisely abut tight against the water-sealing area of the sealing strip thereby, and a water-intake area is indented at an appropriate position of the flat surface thereon wherein the flat surface of the control shaft is allowed to slide along the water-sealing area of the sealing strip and move back-and-forth within the control channel of the tube so as to reduce the contact area there-between, permitting more efforts-saving operation of the control shaft thereby; therefore, depending on the sliding movement of the control shaft, the water-intake area and the flat surface of the control shaft will be switched in position to respectively correspond to the spray nozzle and the water-sealing area thereof, achieving easy control of water discharge thereby.

11. The water shutoff and discharge control device for sprinklers as claimed in claim 10 wherein the water-intake area of the control shaft can be molded in a hole-like shape.

12. The water shutoff and discharge control device for sprinklers as claimed in claim 10 wherein the water-intake area of the control shaft can also be molded in a groove-like shape.

13. The water shutoff and discharge control device for sprinklers as claimed in claim 10 wherein the control shaft has an annular groove indented at both end sections thereon for the mounting of a sealing hoop thereto respectively, a larger-diameter limiting head disposed at one end, and a pair of flexible insert legs symmetrically extending at the other end to fit to a stop sheath with insert holes defining thereon.

14. The water shutoff and discharge control device for sprinklers as claimed in claim 10 wherein the tube has a nozzle housing mounted to the top side thereon, and both end sections and the middle sections of the nozzle housing are respectively disposed multiple oblique guide passages symmetrically arranged to incline sequentially outwards to both sides, and multiple passageways to correspond to the bores of the tube and the spray nozzles of the sealing strip thereby, permitting the spray nozzles arranged at both sides thereof to naturally bend outwards in a sequentially expanding manner so that the water flow ejected from both sides is guided by the oblique angles of the spray nozzles to emit outwards in a dispersing manner, efficiently increasing the sprinkling area in the distribution of water discharge thereby.

* * * * *